US007389074B2

(12) United States Patent
Ebe

(10) Patent No.: US 7,389,074 B2
(45) Date of Patent: Jun. 17, 2008

(54) DEVELOPER HOLDING BODY AND DEVELOPING APPARATUS

(75) Inventor: Takaaki Ebe, Tokyo (JP)

(73) Assignee: Oki Data Corporation, Tokyo (JP)

( * ) Notice: Subject to any disclaimer, the term of this patent is extended or adjusted under 35 U.S.C. 154(b) by 90 days.

(21) Appl. No.: 11/365,236

(22) Filed: Mar. 1, 2006

(65) Prior Publication Data

US 2006/0198664 A1 Sep. 7, 2006

(30) Foreign Application Priority Data

Mar. 3, 2005 (JP) ..... 2005-059102

(51) Int. Cl.
*G03G 15/08* (2006.01)

(52) U.S. Cl. ..... 399/286; 399/279

(58) Field of Classification Search ..... 399/265, 399/276, 279, 286; 347/140
See application file for complete search history.

(56) References Cited

U.S. PATENT DOCUMENTS 5,185,496 A * 2/1993 Nishimura et al. ..... 399/276 X
5,565,968 A * 10/1996 Sawa et al. ..... 399/286
5,729,805 A * 3/1998 Chiba et al. ..... 399/276
6,681,092 B2 * 1/2004 Terai ..... 399/279 X

FOREIGN PATENT DOCUMENTS

JP 09-211964 8/1997
JP 10-048940 A 2/1998
JP 2004-287115 10/2004

* cited by examiner

*Primary Examiner*—Sandra L Brase
(74) *Attorney, Agent, or Firm*—Panitch Schwarze Belisario & Nadel LLP

(57) ABSTRACT

In order to obtain the surface shape which is uniform in each of the circumferential direction and the axial direction without being deviated in one direction on the surface, a developer holding body is provided which is arranged so as to face an image holding body, holds a developer as a layer onto a roughened surface, and supplies the developer in order to develop an image which is formed on the image holding body, and wherein the roughening is executed on the basis of a ratio of cutting depths in a plurality of directions.

18 Claims, 5 Drawing Sheets

$$Rz = \frac{1}{5}\left(\sum_{i=1}^{5} Pi - \sum_{i=1}^{5} Vi\right)$$

$$Smx = \frac{S_1 + S_2 + \cdots + Sn}{n} \qquad Smy = \frac{S_1 + S_2 + \cdots + Sn}{n}$$

$$Sm = \sqrt{Smx^2 + Smy^2}$$

$$tp = \frac{l_1 + l_2 + \cdots + ln}{L} \times 100$$

DEVELOPER HOLDING BODY AND DEVELOPING APPARATUS

BACKGROUND OF THE INVENTION

1. Field of the Invention

The invention relates to a developer holding body for holding a developer and a developing apparatus having such a developer holding body.

2. Related Background Art

A developing apparatus having a developer holding body for holding a developer has been disclosed in JP-A-10-48940. According to such an apparatus disclosed therein, in order to develop an electrostatic latent image formed on an electrostatic latent image holding body by using a developer, after the developer is temporarily held on the developer holding body, the developer holding body is come into contact with the electrostatic latent image holding body, so that the developer held on the developer holding body is supplied onto the electrostatic latent image holding body.

A rough surface is formed on the developer holding body in order to obtain excellent holding characteristics of the developer and its surface shape is shown by unidirectional indices such as: 10-point average roughness Rz showing an interval value between an average of points in a range from a vertex of the largest value to a vertex of the fifth largest value in a roughness curve and an average of points in a range from a bottom point of the minimum value to a bottom point of the fifth minimum value; arithmetic average roughness Ra showing an average of absolute values of height differences between an average line and the roughness curve; an average interval Sm of the rough portions indicative of an interval value between a change point where the roughness curve changes from a mountain to a valley and the next change point; and the like.

SUMMARY OF THE INVENTION

According to the developer holding body whose surface shape is specified on the basis of the indices, in the surface shape of the developer holding body of a rotor, if there is a difference between the roughness shape in the circumferential direction and the roughness shape in the axial direction, that is, if the typical rough surface is formed in either the circumferential direction or the axial direction, such an inconvenience that a stripe appears in a certain direction, a dot drop-out occurs, or the like occurs in a print result.

It is, therefore, an object of the invention to provide a developer holding body of a surface shape which can obtain a good print result and to provide a developing apparatus having such a developer holding body.

According to the present invention, there is provided a developer holding body which is arranged so as to face an image holding body, holds a developer as a layer onto a roughened surface, and supplies the developer in order to develop an image which is formed on the image holding body, wherein the roughening is executed on the basis of a ratio of cutting depths in a plurality of directions.

Moreover, in the developer holding body, the ratio of the cutting depths in the plurality of directions is based on an average of the cutting depths in respective directions at a plurality of load length ratios.

Moreover, in the developer holding body, the ratio of the cutting depths in the plurality of directions lies within a rough surface range from 0.85 or more to 1.18 or less.

Moreover, in the developer holding body, the developer holding body is rotated and the rough surface range is narrowed as a speed of the rotation rises.

Moreover, in the developer holding body, a value of the rough surface range is narrowed as a volume mean grain diameter of the developer which is used increases.

Moreover, in the developer holding body, the roughening is executed under conditions that the ratio of the cutting depths in the plurality of directions lies within a rough surface range from 0.79 or more to 1.26 or less, (5 μm≦10-point average roughness Rz1 in the circumferential direction ≦10 μm), and (5 μm≦10-point average roughness Rz2 in the axial direction ≦10 μm).

Further, according to the present invention, there is also provided a developer holding body which is arranged so as to face an image holding body, holds a developer as a layer onto a roughened surface, and supplies the developer in order to develop an image which is formed on the image holding body, wherein assuming that a cutting depth at the time when a load length ratio in the circumferential direction of the surface of the developer holding body is equal to n % is set to $C_{1vn}$ [μm] and a cutting depth at the time when a load length ratio in the axial direction of the surface is equal to n % is set to $C_{2vn}$ [μm], a relational expression $$0.85 \le \frac{\sum_{n=m1}^{m2} \frac{C1vn}{C2nv}}{k} \le 1.18$$

where, n, m1, m2: real numbers (0<m1≦m2≦100)

k: the number of n is satisfied.

Moreover, in the developer holding body, in a ratio of the cutting depth in the circumferential direction of the surface to the cutting depth in the axial direction of the surface which is shown by $C_{1vn}/C_{2vn}$ shown by the relational expression, and a value of n % of each of the load length ratio in the circumferential direction of the surface and the load length ratio in the axial direction of the surface is equal to a value of one of (n=10, 20, 30, 40, 50, 60, 70, 80, 90).

Further, according to the present invention, there is also provided a developer holding body which is arranged so as to face an image holding body, holds a developer as a layer onto a roughened surface, and supplies the developer in order to develop an image which is formed on the image holding body, wherein assuming that a cutting depth at the time when a load length ratio in the circumferential direction of the surface of the developer holding body is equal to n % is set to $C_{1vn}$ [μm], a cutting depth at the time when a load length ratio in the axial direction of the surface is equal to n % is set to $C_{2vn}$ [μm], a 10-point average roughness in the circumferential direction of the surface of the developer holding body is set to Rz1, and a 10-point average roughness in the axial direction of the surface is set to Rz2, respectively, relational expressions $$0.79 \le \frac{\sum_{n=m1}^{m2} \frac{C1vn}{C2nv}}{k} \le 1.26$$

5 μm≦Rz1≦10 μm, and

5 μm≦Rz2≦10 μm where, n, m1, m2: real numbers ($0<m1 \leqq m2 \leqq 100$)

k: the number of n are satisfied.

Moreover, in the developer holding body, in a ratio of the cutting depth in the circumferential direction of the surface to the cutting depth in the axial direction of the surface which is shown by $C_{1vn}/C_{2vn}$ shown by the relational expression, and a value of n % of each of the load length ratio in the circumferential direction of the surface and the load length ratio in the axial direction of the surface is equal to a value of one of (n=10, 20, 30, 40, 50, 60, 70, 80, 90).

Further, according to the present invention, there is provided a developing apparatus having a developer holding body which is arranged so as to face an image holding body, holds a developer as a layer onto a roughened surface, and supplies the developer in order to develop an image which is formed on the image holding body, wherein the roughening is executed on the basis of a ratio of cutting depths in a plurality of directions.

Moreover, in the developing apparatus, the ratio of the cutting depths in the plurality of directions is based on an average of the cutting depths in respective directions at a plurality of load length ratios.

Moreover, in the developing apparatus, the ratio of the cutting depths in the plurality of directions lies within a rough surface range from 0.85 or more to 1.18 or less.

Moreover, in the developing apparatus, the developer holding body is rotated and the rough surface range is narrowed as a speed of the rotation rises.

Moreover, in the developing apparatus, a value of the rough surface range is narrowed as a volume mean grain diameter of the developer which is used increases.

Moreover, in the developing apparatus, the roughening is executed under conditions that the ratio of the cutting depths in the plurality of directions lies within a rough surface range from 0.79 or more to 1.26 or less, (5 μm≦10-point average roughness Rz1 in the circumferential direction ≦10 μm), and (5 μm≦10-point average roughness Rz2 in the axial direction ≦10 μm).

Further, according to the present invention, there is also provided a developing apparatus which is arranged so as to face an image holding body, holds a developer as a layer onto a roughened surface, and supplies the developer in order to develop an image which is formed on the image holding body, wherein assuming that a cutting depth at the time when a load length ratio in the circumferential direction of the surface of the developer holding body is equal to n % is set to $C_{1vn}$ [μm] and a cutting depth at the time when a load length ratio in the axial direction of the surface is equal to n % is set to $C_{2vn}$ [μm], a relational expression $$0.85 \leq \frac{\sum_{n=m1}^{m2} \frac{C1vn}{C2nv}}{k} \leq 1.18$$

where, n, m1, m2: real numbers ($0 \leqq m1 \leqq m2 \leqq 100$)

k: the number of n is satisfied.

Moreover, in the developing apparatus, in a ratio of the cutting depth in the circumferential direction of the surface to the cutting depth in the axial direction of the surface which is shown by $C_{1vn}/C_{2vn}$ shown by the relational expression, and a value of n % of each of the load length ratio in the circumferential direction of the surface to the load length ratio in the axial direction of the surface is equal to a value of one of (n=10, 20, 30, 40, 50, 60, 70, 80, 90).

Further, according to the present invention, there is also provided a developing apparatus which is arranged so as to face an image holding body, holds a developer as a layer onto a roughened surface, and supplies the developer in order to develop an image which is formed on the image holding body, wherein assuming that a cutting depth at the time when a load length ratio in the circumferential direction of the surface of the developer holding body is equal to n % is set to $C_{1vn}$ [μm], a cutting depth at the time when a load length ratio in the axial direction of the surface is equal to n % is set to $C_{2vn}$ [μm], a 10-point average roughness in the circumferential direction of the surface of the developer holding body is set to Rz1, and a 10-point average roughness in the axial direction of the surface is set to Rz2, respectively, relational expressions $$0.79 \leq \frac{\sum_{n=m1}^{m2} \frac{C1vn}{C2nv}}{k} \leq 1.26$$

$5\ \mu m \leqq Rz1 \leqq 10\ \mu m$, and $5\ \mu m \leqq Rz2 \leqq 10\ \mu m$ where, n, m1, m2: real numbers ($0<m1 \leqq m2 \leqq 100$)

k: the number of n are satisfied.

Moreover, in the developing apparatus, in a ratio of the cutting depth in the circumferential direction of the surface to the cutting depth in the axial direction of the surface which is shown by $C_{1vn}/C_{2vn}$ shown by the relational expression, and a value of n % of each of the load length ratio in the circumferential direction of the surface to the load length ratio in the axial direction of the surface is equal to a value of one of (n=10, 20, 30, 40, 50, 60, 70, 80, 90).

According to the invention, by roughening the surface of the developer holding body by using a ratio of cutting depths in a plurality of directions as an index, the differences among the surface roughness shapes in the respective directions can be reduced and the developer holding body of the surface roughness shape which is uniform in each direction can be obtained. Therefore, the printing process using the developer holding body can prevent the defective printing such as dot drop-out or the like which is caused since the typical rough surface is formed in either the circumferential direction or the axial direction. The excellent print result can be obtained.

Other features and advantages of the present invention will be apparent from the following description taken in conjunction with the accompanying drawings, in which like reference characters designate the same or similar parts throughout the figures thereof.

DETAILED DESCRIPTION OF THE PREFERRED EMBODIMENTS

Figure 1:
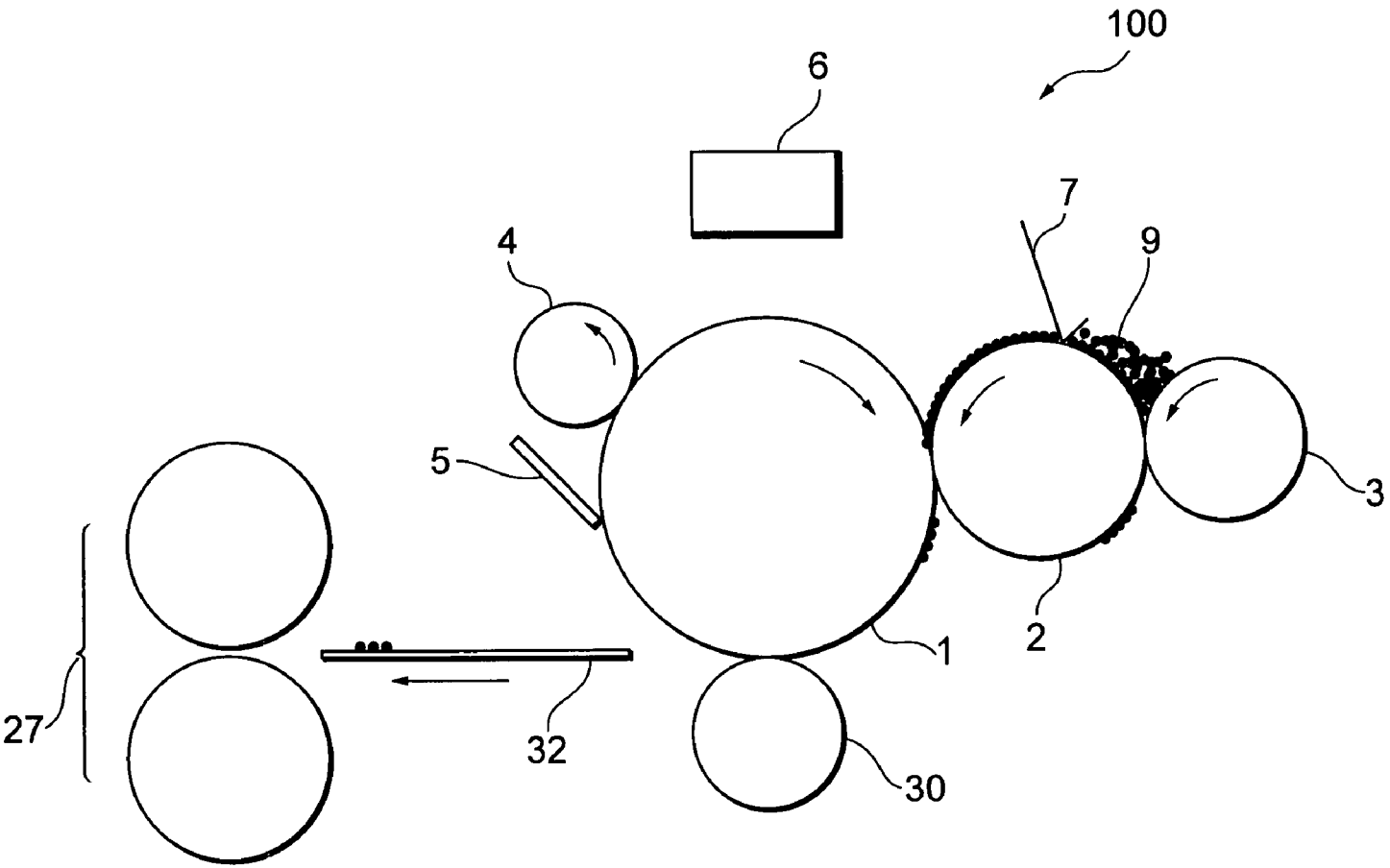
FIG. 1 is a schematic cross sectional view of a mechanism of a developing apparatus.

Embodiments of the invention will be described in detail hereinbelow with reference to the drawings. The same or similar component elements in the following drawings which are used in the embodiments are designated by the same reference numerals and their overlapped explanation is omitted as much as possible.

Embodiment 1

As shown in FIG. 1, a developing apparatus 100 of the invention is constructed by: a photosensitive drum 1 serving as an electrostatic latent image holding body as a feature of the invention; a developing roller 2 serving as a developer holding body; a supplying roller 3 for supplying toner as a developer to the developing roller; a charging roller 4 serving as a charging apparatus for charging the surface of the photosensitive drum 1; a cleaning blade (cleaning roller) 5 for cleaning the surface of the photosensitive drum 1 prior to the charging process by the charging roller 4; an exposing unit 6 serving as an LED head for exposing the charged surface of the photosensitive drum 1 on the basis of image data; and a toner layer thickness restricting member 7 for restricting toner 9 supplied from the supplying roller 3 to the developing roller 2 and thinning a toner layer.

The toner layer thickness restricting member 7 is a stainless plate having a thickness of 0.08 mm. Its edge portion is bent at 90° with a curvature of 0.19 mm and its bent portion is in contact with the developing roller 2 at a linear load of 5 g/mm.

The photosensitive drum 1 has a cylindrical shape as a rotor and its diameter is equal to 30 mm. The developing roller 2 also has a cylindrical shape as a rotor and its diameter is equal to 16 mm.

The photosensitive drum 1 and the developing roller 2 are in contact with each other as shown in FIG. 1. Specifically speaking, the photosensitive drum 1 and the developing roller 2 are in contact with each other by a bite amount of 0.1 mm. The developing roller 2 is rotated at a peripheral speed ratio of 1.19 for the photosensitive drum 1.

The supplying roller 3 also has a cylindrical shape as a rotor and its diameter is equal to 15 mm. An outer periphery of the supplying roller 3 is made of a sponge-like silicone rubber and its hardness is equal to 50° as an Asker F hardness when it is measured by an Asker hardness meter. The supplying roller 3 and the developing roller 2 are in contact with each other as shown in FIG. 1. Specifically speaking, the supplying roller 3 and the developing roller 2 are in contact with each other by a bite amount of 1.1 mm.

Each of arrows shown in FIG. 1 indicates the rotating direction of each drum. For example, the supplying roller 3 which is come into contact with the developing roller 2 which rotates counterclockwise also rotates counterclockwise. Therefore, the supplying roller 3 which is come into contact with the developing roller 2 which rotates counterclockwise against the rotation of the developing roller. On the other hand, the photosensitive drum 1 which is come into contact with the developing roller 2 which rotates counterclockwise rotates clockwise, that is, the photosensitive drum 1 and the developing roller 2 rotate mutually in the forward direction.

After the surface of the photosensitive drum 1 is charged by the charging roller 4, it is exposed by the exposing unit 6 on the basis of the image data, so that an electrostatic latent image is formed. During this period of time, the layer of the toner supplied from the supplying roller 3 to the developing roller 2 is thinned on the developing roller 2 by the toner layer thickness restricting member 7 and the toner layer on the developing roller 2 is come into contact with the photosensitive drum 1 on which the electrostatic latent image has been formed, so that a toner image is formed on the photosensitive drum 1 in accordance with the electrostatic latent image.

The photosensitive drum 1 on which the toner image has been formed is come into pressure contact by a transfer roller 30 through a sheet as a print medium and the toner image is transferred onto the sheet. A sheet 32 on which the toner image has been transferred is fixed by a fixing device 27 and an image according to the toner image is formed on the sheet.

The developing apparatus 100 of the invention has been built in a printer 200 or the like serving as an image forming apparatus. Each of the rollers is controlled in each functional block shown in FIG. 2.

Figure 2:
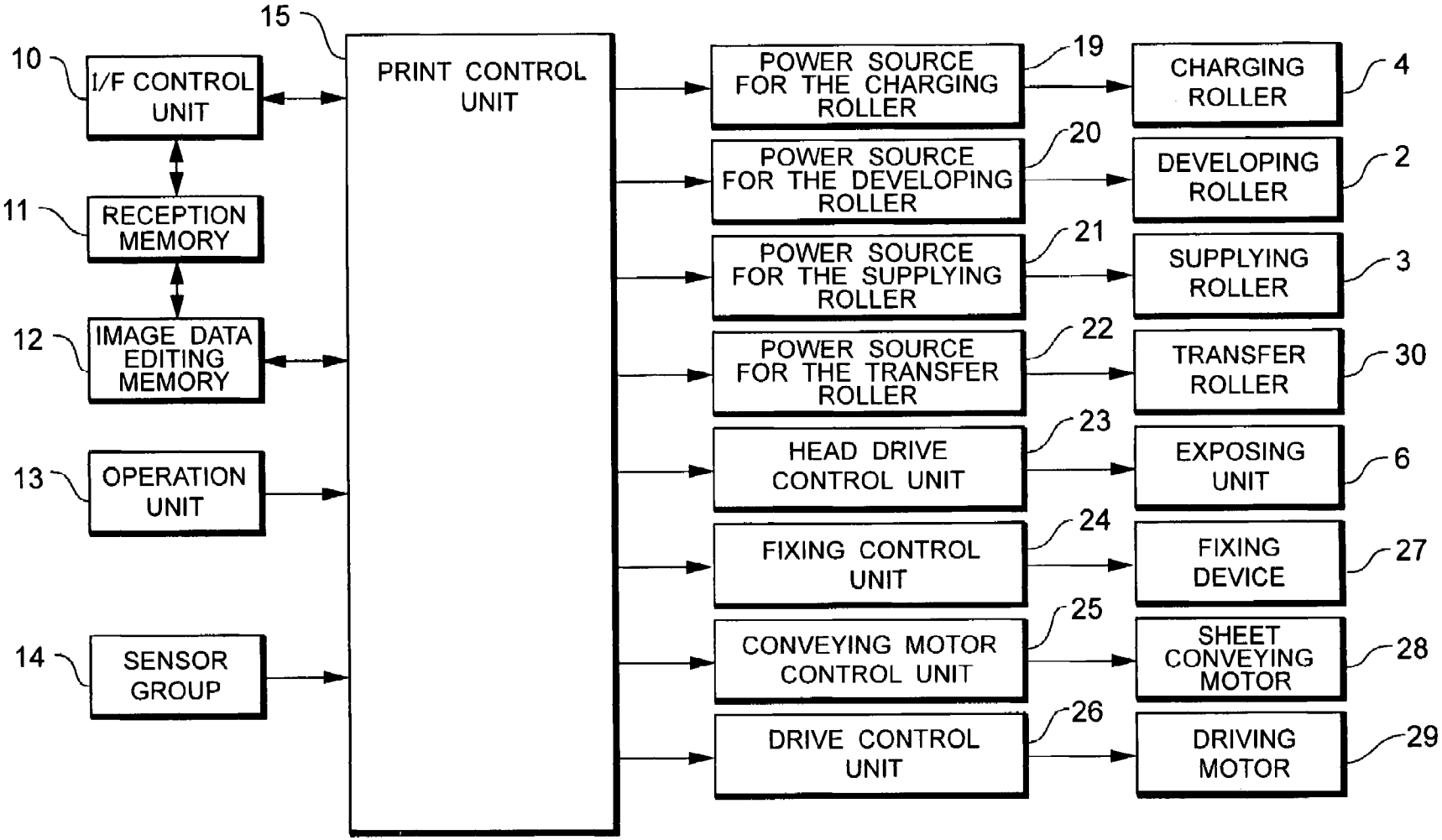
FIG. 2 is a functional block diagram of an image forming apparatus.

As shown in FIG. 2, the printer 200 has: an I/F (interface) control unit 10 for communicating with an upper apparatus (not shown); a reception memory 11 for holding print data which is obtained through the I/F control unit 10; an image data editing memory 12 for reading out the print data from the reception memory 11, executing an image process, forming the image data, and holding it; an operation unit 13 for allowing an operating mode of the printer 200 to be displayed and receiving an operating instruction from the user; and a group of sensors 14 which are arranged in the printer 200 and monitor the operating mode and an operation environment of the printer 200. As a sensor group 14, for example, a sheet position detecting sensor to detect the position of the sheet, a temperature/humidity sensor, a concentration sensor, and the like are provided.

Further, the printer 200 has: a power source 19 (for the charging roller) for applying a predetermined voltage to the charging roller 4; a power source 20 (for the developing roller) for applying a predetermined voltage to the developing roller 2; a power source 21 (for the supplying roller) for applying a predetermined voltage to the supplying roller 3; a power source 22 (for the transfer roller) for applying a predetermined voltage to the transfer roller 30; a head drive control unit 23 for controlling the exposing unit 6 (LED head); and a fixing control unit 24 for controlling the fixing device 27. The fixing control unit 24 controls a temperature of a heater (not shown) equipped for the fixing device 27 on the basis of an output from the temperature sensor (not shown) and fusing the toner of the toner image transferred onto the sheet 32, thereby fixing it.

Further, the printer 200 has: a conveying motor control unit 25 for controlling each sheet conveying roller (not shown) by controlling a sheet conveying motor 28; a drive control unit 26 for controlling the rotation of the photosensitive drum 1 by controlling a driving motor 29; and a print control unit 15 for integratedly controlling each of the foregoing units.

The operation of the printer 200 will now be described.

The print data received through the I/F control unit 10 is held in the reception memory 11. The print control unit 15 reads out the print data from the reception memory 11, forms the image data by image-processing the print data, and allows the image data to be temporarily held in the image data editing memory 12.

The print control unit 15 properly instructs each of the power source 19 for the charging roller, the power source 20 for the developing roller, the power source 21 for the supplying roller, the power source 22 for the transfer roller, the head drive control unit 23, the fixing control unit 24, the conveying motor control unit 25, and the drive control unit 26. For example, when the print control unit 15 instructs the conveying motor control unit 25, the conveying motor control unit 25 controls the sheet conveying motor 28 for conveying the sheet, thereby conveying the sheet.

The print control unit 15 instructs the drive control unit 26 to control the driving motor 29 so as to rotate the photosensitive drum 1. In association with the rotation of the photosensitive drum 1, the supplying roller 3, developing roller 2, photosensitive drum 1, charging roller 4, and transfer roller 30 rotate in the directions shown by the arrows in FIG. 1.

The print control unit 15 instructs the power source 19 for the charging roller to allow the charging roller 4 to charge the surface of the photosensitive drum 1 cleaned by the cleaning blade 5. When the surface of the photosensitive drum 1 is charged, the print control unit 15 instructs the head drive control unit 23 to read out the image data from the image data editing memory 12 and form the electrostatic latent image based on the image data onto of the photosensitive drum 1 by the exposing unit 6.

For this period of time, the voltages have been applied to the developing roller 2 and the supplying roller 3 on the basis of the instructions from the print control unit 15, thereby improving a holding force of the toner on the roller by the charging by the voltage supply. When the toner 9 is supplied to the developing roller 2 from the supplying roller 3, the developing roller 2, the surplus toner is restricted by the toner layer thickness restricting member 7 and toner particles are formed in the thin toner layer on the surface. The electrostatic latent image formed on the photosensitive drum 1 is developed by the toner layer formed on the developing roller 2 and the toner image is formed.

The print control unit 15 instructs the power source 22 for the transfer roller to drive the transfer roller 30 so as to form a mirror image of the toner image onto the conveyed sheet. After that, the print control unit 15 instructs the fixing control unit 24 to control the fixing device 27 so as to fix the toner image on the sheet and form the image onto the sheet.

The surface shape of the developing roller 2 of the invention is formed on the basis of evaluating tests. Specifically speaking, the developing rollers having the different surface shapes are formed, the evaluating test in each of the developing rollers is executed, and the surface shape of the developing roller is formed in accordance with specifications which have been predetermined on the basis of test results.

The evaluating tests will now be specifically explained.

A painted lateral stripe pattern whose print area is equal to 1% (print duty of 1%) is printed in the longitudinal direction on the sheet of, for example, the A4 size by using the foregoing printer 200 and this process is repeated 500 times. That is, the painted lateral stripe pattern is printed to 500 sheets. After that, in the printing of a resolution of 600 dpi (dots per inch), there is executed what is called "2-by-2 pattern printing" (print duty of 50%) in which such processes that total four dots comprising of two dots in the vertical direction and two dots in the lateral direction is set to one block, the print data of one block is printed, and subsequently, a blank of total four dots comprising of two dots in the vertical direction and two dots in the lateral direction is provided as one blank block are repeated. Subsequently, whether or not there is a dot drop-out in a print result is discriminated.

By executing the printing of a low duty of 1% prior to executing the 2-by-2 pattern printing, the developing apparatus 100 is continuously operated in the state where toner consumption is small. The toner 9 in the developing apparatus 100 is agitated by an agitator (not shown. Thus, a charging degree of the toner 9 in the developing apparatus 100 can be increased.

Consequently, the thickness of toner layer on the developing roller 2 enters a saturation state and a variation occurs in the charging of each toner. A mirror image force becomes unstable due to such a variation in charging distribution. What is called an "expulsion" or "drop-out" in which the toner which has to be deposited is not deposited or the toner is deposited to surplus portions is liable to occur in accordance with the electrostatic latent image. The print result can be easily and precisely examined by inducing defective printing. For this purpose, the print evaluating tests are performed under the foregoing conditions.

The toner 9 which is used in the evaluating tests is manufactured by a grinding method and its volume mean grain diameter is set to 4 μm, 5 μm, 5.5 μm, 6 μm, 6.5 μm, 7 μm, and 8 μm, respectively. The evaluating test is performed at the volume mean grain diameter of each toner.

A print speed is set to 16 ppm, 20 ppm, 24 ppm, and 32 ppm in the A4 portrait size. In other words, the evaluating tests are performed at the print speeds in which the peripheral speed of the photosensitive drum 1 is set to 94 mm/sec, 117 mm/sec, 140 mm/sec, and 186 mm/sec, respectively.

Figure 3:
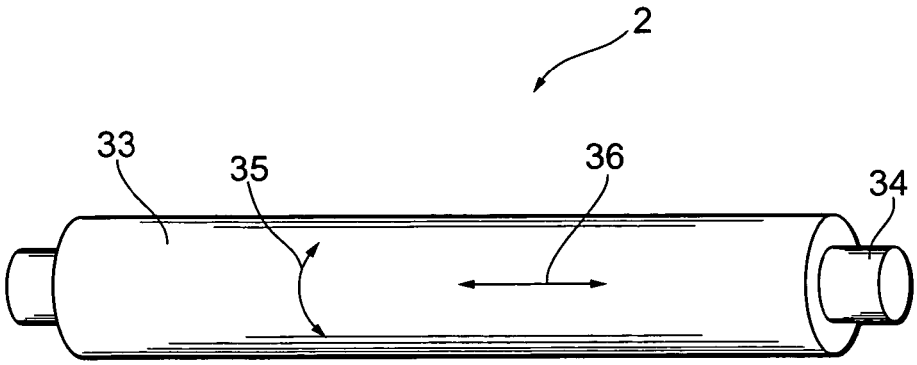
FIG. 3 is a schematic diagram of a developing roller.

As shown in FIG. 3, the developing roller 2 which is used for the evaluating test is constructed in such a manner that a rubber layer 33 whose hardness is equal to JIS-A 50° is formed in a roll shape as an elastic layer onto a core metal (axial metal) 34. On the surface of the rubber layer 33, the longitudinal direction of the core metal 34 shown in FIG. 3 is called an axial direction 36, the short-side direction is called a circumferential direction 35, and explanation will be made hereinbelow.

The inventors prepare the six developing rollers 2, execute the surface roughening process so that the surfaces of the developing rollers 2 become different surface shapes, and measure the roughness of the surface shapes.

The measurement of the roughness of the surface shapes is performed at a microscopic magnification of 750 times by using a scanning laser microscope 1LM15 made by Laser Tech Co., Ltd. An arithmetic operation is executed by using annexed image analyzing software SALT. The 10-point average roughness Rz, arithmetic average roughness Ra, and average interval Sm of the rough portions, which will be explained hereinafter, are obtained.

The surface shapes of the developing rollers 2 are shown in Table 1 on the basis of indices such as 10-point average roughness Rz, arithmetic average roughness Ra, average interval Sm of the rough portions, and the like.

TABLE 1

| | | Test patterns | | | | | |
|---|---|---|---|---|---|---|---|
| | | Rz [μm] | | Ra [μm] | | Sm [μm] | |
| | Elastic layer | Circumferential direction | Axial direction | Circumferential direction | Axial direction | Circumferential direction | Axial direction |
| 1st | Rubber of JIS-A50° | 6.79 | 7.07 | 1.36 | 1.37 | 5.98 | 8.15 |
| 2nd | Rubber of JIS-A50° | 6.28 | 5.32 | 1.20 | 1.07 | 5.65 | 7.97 |
| 3rd | Rubber of JIS-A50° | 6.60 | 6.28 | 1.14 | 1.37 | 5.00 | 9.83 |
| 4th | Rubber of JIS-A50° | 4.14 | 4.01 | 0.83 | 0.79 | 6.11 | 6.63 |
| 5th | Rubber of JIS-A50° | 4.18 | 8.12 | 1.40 | 1.97 | 11.49 | 13.54 |
| 6th | Rubber of JIS-A50° | 8.83 | 11.18 | 1.96 | 2.19 | 6.20 | 7.96 |

Figure 4:
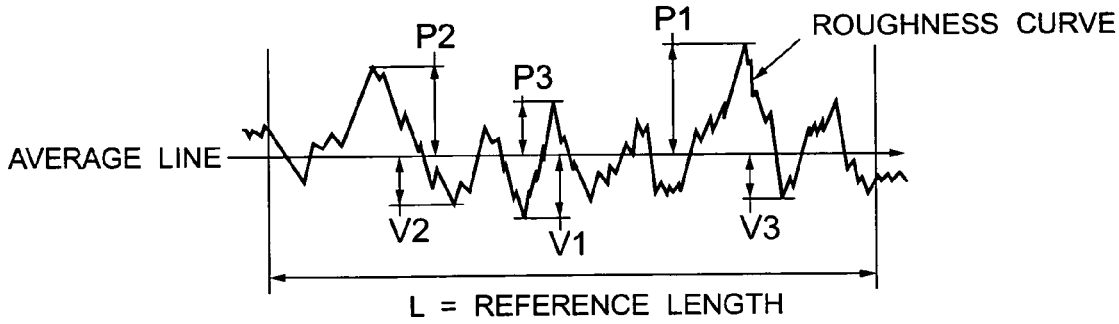
FIG. 4 is an explanatory diagram of a 10-point average roughness Rz.
Figure 5:
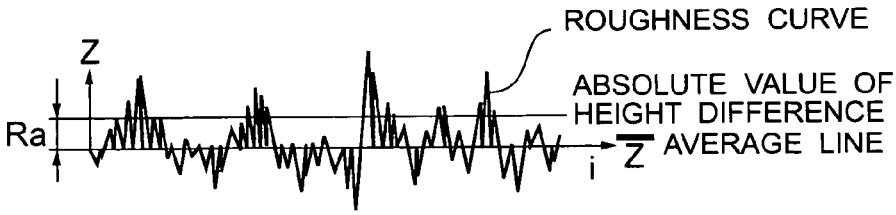
FIG. 5 is an explanatory diagram of an arithmetic average roughness Ra.
Figure 6:
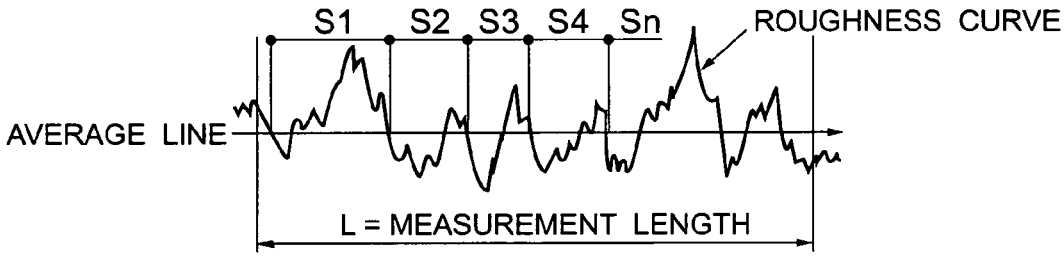
FIG. 6 is an explanatory diagram of an average interval Sm of rough portions.

In Table 1, as shown in FIG. 4, the 10-point average roughness Rz shows an interval value between the average of points in a range from a vertex of the largest value to a vertex of the fifth largest value in a roughness curve and an average of points in a range from a bottom point of the minimum value to a bottom point of the fifth minimum value. As shown in FIG. 5, the arithmetic average roughness Ra shows an average of absolute values of height differences between an average line and the roughness curve. As shown in FIG. 6, the average interval Sm of the rough portions indicates a value of an interval between a change point where the roughness curve changes from a mountain to a valley and the next change point. In each of them, the values regarding the circumferential direction and the axial direction are shown and their unit is μm.

For example, according to the first developing roller 2 in Table 1, as for the 10-point average roughness Rz, the value in the circumferential direction is equal to 6.79 μm and the value in the axial direction is equal to 7.07 μm; as for the arithmetic average roughness Ra, the value in the circumferential direction is equal to 1.36 μm and the value in the axial direction is equal to 1.37 μm; and as for the average interval Sm of the rough portions, the value in the circumferential direction is equal to 5.98 μm and the value in the axial direction is equal to 8.15 μm, respectively.

Each of the 10-point average roughness Rz, the arithmetic average roughness Ra, and the average interval Sm between the concave and convex portions in Table 1 does not include information regarding the direction and is nothing but an index merely showing the surface shape in a single direction.

Each of the 10-point average roughness Rz, the arithmetic average roughness Ra, and the average interval Sm between the concave and convex portions shown in Table 1 includes only information regarding the difference between the concave and convex portions or information regarding the interval between the concave and convex portions and does not include, for example, information regarding a width of concave portion showing the concave portion shape, information regarding a width of convex portion showing the convex portion shape, and the like. Further, as will be obvious from Table 1, each of the 10-point average roughness Rz, the arithmetic average roughness Ra, and the average interval Sm additionally needs information regarding the direction on a plane of the developing roller 2, that is, information regarding the axial direction and the circumferential direction and each of those indices does not include information regarding the direction on the plane of the developing roller 2.

A load length ratio tp and a cutting depth Cv each including the information regarding the direction on the surface of the developing roller 2 will be described as new indices here. First, an outline of the load length ratio tp and the cutting depth Cv will be explained.

Figure 7:
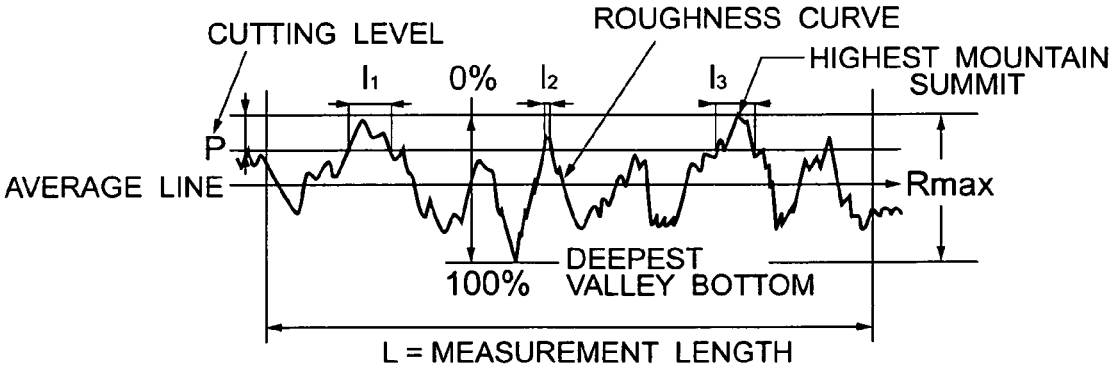
FIG. 7 is an explanatory diagram of a load length ratio tp.

As shown in FIG. 7, the load length ratio tp is a value of a percentage (%) of a length of a cutting portion to a measurement length at the time when a roughness curve is cut at a certain cutting level. In the case where the highest vertex (highest mountain summit) in the roughness curve is set to 0% and the lowest point (deepest valley bottom) is set to 100%, it is assumed that the cutting level is obtained on a unit basis of 1%.

Figure 8:
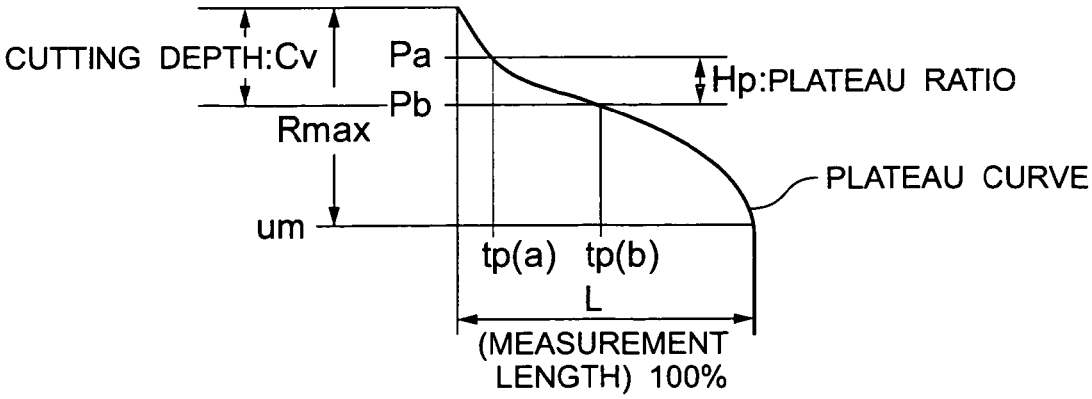
FIG. 8 is an explanatory diagram of a plateau ratio Hp and a cutting depth.

In FIG. 7 used for the explanation of the load length ratio tp, a difference between a cutting level Pa when the load length ratio is equal to tp(a) % and a cutting level Pb when the load length ratio is equal to tp(b) % is called a plateau ratio Hp (refer to FIG. 8). Particularly, a difference between Pa and Pb when tp(a) is fixed to tp(0) % is called a cutting depth. Since both of the load length ratio and the cutting depth include the information regarding the width of convex portion and the information regarding the width of concave portion, they are suitable as indices at the time of roughening the surface.

The load length ratio tp and the cutting depth Cv including the information regarding the direction on the surface of the developing roller 2 will be described.

In each developing roller 2, cutting depths $C_{1vn}$ in the case where the load length ratio tp in the circumferential direction of the developing roller 2 is equal to n % (where, n=0, 10, 20, 30, 40, 50, 60, 70, 80, 90) are obtained. The cutting depths $C_{1vn}$ in each developing roller are collected every load length ratio tp and its result is shown in Table 2.

TABLE 2

| | Cutting depths $C_{1vn}$ in the circumferential direction of the surface of the developing roller | | | | | | | | | |
|---|---|---|---|---|---|---|---|---|---|---|
| | $C_{1V0}$ | $C_{1V10}$ | $C_{1V20}$ | $C_{1V30}$ | $C_{1V40}$ | $C_{1V50}$ | $C_{1V60}$ | $C_{1V70}$ | $C_{1V80}$ | $C_{1V90}$ |
| 1st | 0 | 2.58 | 3.38 | 3.92 | 4.40 | 4.90 | 5.35 | 5.76 | 6.14 | 6.98 |
| 2nd | 0 | 1.99 | 2.78 | 3.25 | 3.68 | 4.04 | 4.41 | 4.83 | 5.36 | 5.94 |
| 3rd | 0 | 2.18 | 2.85 | 3.25 | 3.56 | 3.91 | 4.28 | 4.68 | 5.15 | 5.93 |
| 4th | 0 | 1.62 | 2.09 | 2.42 | 2.76 | 3.07 | 3.31 | 3.56 | 3.86 | 4.19 |
| 5th | 0 | 2.62 | 3.26 | 3.76 | 4.09 | 4.72 | 5.27 | 5.91 | 6.45 | 6.98 |
| 6th | 0 | 3.39 | 4.39 | 5.17 | 5.82 | 6.35 | 6.83 | 7.50 | 8.35 | 10.03 |

In each developing roller 2, cutting depths $C_{2vn}$ in the case where the load length ratio tp in the axial direction of the developing roller 2 is equal to n % (where, n=0, 10, 20, 30, 40, 50, 60, 70, 80, 90) are obtained. The cutting depths $C_{2vn}$ in each developing roller are collected every load length ratio tp and its result is shown in Table 3.

TABLE 3

| | Cutting depths $C_{2vn}$ in the axial direction of the surface of the developing roller | | | | | | | | | |
|---|---|---|---|---|---|---|---|---|---|---|
| | $C_{2V0}$ | $C_{2V10}$ | $C_{2V20}$ | $C_{2V30}$ | $C_{2V40}$ | $C_{2V50}$ | $C_{2V60}$ | $C_{2V70}$ | $C_{2V80}$ | $C_{2V90}$ |
| 1st | 0 | 3.33 | 4.24 | 4.77 | 5.25 | 5.66 | 6.07 | 6.46 | 7.00 | 7.72 |
| 2nd | 0 | 2.35 | 2.99 | 3.42 | 3.82 | 4.21 | 4.59 | 4.91 | 5.25 | 5.70 |
| 3rd | 0 | 2.35 | 2.84 | 3.24 | 3.68 | 4.15 | 4.60 | 5.17 | 5.84 | 6.59 |
| 4th | 0 | 1.62 | 1.95 | 2.22 | 2.48 | 2.76 | 3.04 | 3.35 | 3.69 | 4.15 |
| 5th | 0 | 3.21 | 4.51 | 5.44 | 5.83 | 6.40 | 6.89 | 7.68 | 8.38 | 9.87 |
| 6th | 0 | 4.74 | 5.87 | 6.74 | 7.47 | 8.12 | 8.77 | 9.42 | 10.35 | 11.95 |

As shown in Tables 2 and 3, since a value of a percentage (%) of the load length ratio tp is equal to 0 in each of the cutting depths $C_{1vn}$ and $C_{2vn}$, explanation will be made hereinbelow by using only the result in the case where tp lies within a range of 10 to 90%.

As shown in Table 4, a ratio of the cutting depths $C_{1vn}$ obtained at the load length ratio tp in the circumferential direction (where, n=10, 20, 30, 40, 50, 60, 70, 80, 90) to the cutting depths $C_{2vn}$ obtained at the load length ratio tp in the axial direction (where, n=10, 20, 30, 40, 50, 60, 70, 80, 90) is obtained every percentage (%) of each load length ratio tp and an average of the obtained ratios is obtained as a cutting depth $C_{12AVE}$.

TABLE 4

| | Ratio $C_{1vn}/C_{2vn}$ between the cutting depths in the circumferential direction and the axial direction | | | | | | | | | |
|---|---|---|---|---|---|---|---|---|---|---|
| | $C_{1V10}/C_{2V10}$ | $C_{1V20}/C_{2V20}$ | $C_{1V30}/C_{2V30}$ | $C_{1V40}/C_{2V40}$ | $C_{1V50}/C_{2V50}$ | $C_{1V60}/C_{2V60}$ | $C_{1V70}/C_{2V70}$ | $C_{1V80}/C_{2V80}$ | $C_{1V90}/C_{2V90}$ | Average |
| 1st | 0.775 | 0.799 | 0.822 | 0.838 | 0.865 | 0.882 | 0.892 | 0.877 | 0.905 | 0.850 |
| 2nd | 0.849 | 0.929 | 0.951 | 0.963 | 0.960 | 0.961 | 0.984 | 1.022 | 1.042 | 0.962 |
| 3rd | 0.926 | 1.004 | 1.002 | 0.967 | 0.941 | 0.931 | 0.905 | 0.882 | 0.900 | 0.940 |
| 4th | 0.998 | 1.075 | 1.092 | 1.113 | 1.111 | 1.088 | 1.064 | 1.046 | 1.010 | 1.066 |
| 5th | 0.815 | 0.724 | 0.692 | 0.702 | 0.738 | 0.764 | 0.769 | 0.770 | 0.708 | 0.742 |
| 6th | 0.716 | 0.748 | 0.766 | 0.779 | 0.782 | 0.778 | 0.796 | 0.807 | 0.840 | 0.779 |

As a load length ratio tp, the obtained cutting depth $C_{12AVE}$ includes surface roughness information in the circumferential direction and surface roughness information in the axial direction as a ratio between the cutting depths $C_{1vn}$ and $C_{2vn}$. The nearer a value of such a ratio approaches "1", the smaller the difference between the surface roughness in the circumferential direction and the surface roughness in the axial direction is, and the uniform surface roughness is obtained in each direction.

The evaluating tests in which the 2-by-2 pattern printing is executed after completion of the low-duty printing of 1% mentioned above are executed by using the developing rollers 2 whose surfaces have been roughened, respectively. 100 formed dots are extracted from the print result by using the image analyzing software SALT, its area is measured, a diameter of a circular area corresponding to the measured area is obtained, and a comparison discrimination is made on the basis of a standard deviation σ of the diameter of the circle corresponding to the 100 dots.

In this comparison discrimination, as shown in Table 5, a table in which the print result when the standard deviation σ≦4.3 is indicated by "o" showing that the dot drop-out is inconspicuous when it is observed by the eyes and the print result when the standard deviation σ>4.3 is indicated by "×" showing that the dot drop-out is conspicuous when it is observed by the eyes is formed at each of the print speeds of 16 ppm and 20 ppm, and the dot drop-out due to the difference between the volume mean grain diameters of the toner particles in each print speed is shown as a table. As shown in Table 6, the dot drop-out states in the print speeds of 24 ppm and 32 ppm are similarly shown as a table in place of the print speeds of 16 ppm and 20 ppm. Although the value of the standard deviation σ has been set to 4.3 as a reference value in the general evaluating inspection, the invention is not limited to such a value but the set value can be also properly changed.

TABLE 5

| | Printing test results (when 16 ppm, 20 ppm) | | | | | | | | | | | | | |
|---|---|---|---|---|---|---|---|---|---|---|---|---|---|---|
| | Print speed | | | | | | | | | | | | | |
| | 16 ppm | | | | | | | 20 ppm | | | | | | |
| Toner grain diameter [μm] | 4 | 5 | 5.5 | 6 | 6.5 | 7 | 8 | 4 | 5 | 5.5 | 6 | 6.5 | 7 | 8 | $C_{12AVE}$ |
| 1st | ○ | ○ | ○ | ○ | ○ | ○ | X | ○ | ○ | ○ | ○ | ○ | ○ | X | 0.850 |
| 2nd | ○ | ○ | ○ | ○ | ○ | ○ | ○ | ○ | ○ | ○ | ○ | ○ | ○ | ○ | 0.962 |
| 3rd | ○ | ○ | ○ | ○ | ○ | ○ | ○ | ○ | ○ | ○ | ○ | ○ | ○ | ○ | 0.940 |
| 4th | ○ | ○ | ○ | ○ | ○ | ○ | ○ | ○ | ○ | ○ | ○ | ○ | ○ | ○ | 1.066 |
| 5th | X | X | X | X | X | X | X | X | X | X | X | X | X | X | 0.742 |
| 6th | X | X | X | X | X | X | X | X | X | X | X | X | X | X | 0.779 |

TABLE 6

| | Printing test results (when 24 ppm, 32 ppm) | | | | | | | | | | | | | |
|---|---|---|---|---|---|---|---|---|---|---|---|---|---|---|
| | Print speed | | | | | | | | | | | | | |
| | 24 ppm | | | | | | | 32 ppm | | | | | | |
| Toner grain diameter [μm] | 4 | 5 | 5.5 | 6 | 6.5 | 7 | 8 | 4 | 5 | 5.5 | 6 | 6.5 | 7 | 8 | $C_{12AVE}$ |
| 1st | ○ | ○ | ○ | ○ | X | X | X | ○ | ○ | ○ | ○ | X | X | X | 0.850 |
| 2nd | ○ | ○ | ○ | ○ | X | X | X | ○ | ○ | ○ | ○ | X | X | X | 0.962 |
| 3rd | ○ | ○ | ○ | ○ | X | X | X | ○ | ○ | ○ | ○ | X | X | X | 0.940 |
| 4th | ○ | ○ | ○ | ○ | X | X | X | ○ | ○ | ○ | ○ | X | X | X | 1.066 |
| 5th | X | X | X | X | X | X | X | X | X | X | X | X | X | X | 0.742 |
| 6th | X | X | X | X | X | X | X | X | X | X | X | X | X | X | 0.779 |

As will be obvious from Table 5 and Table 6, the larger the volume mean grain diameter of the toner is and the higher the print speed is, the more the defective printing such as dot drop-out or the like is liable to occur. The following reason is considered for such a problem. That is, the larger the volume mean grain diameter of the toner is and the higher the print speed is, for example, the more a frictional force or heat is applied to each toner in the toner layer on the developing roller 2, so that a variation occurs in charging performance of the toner layer. Consequently, the toner is supplied from the developing roller 2, the development of the electrostatic latent image on the photosensitive drum 1 is not normally executed, and the defective printing such as dot drop-out or the like is liable to occur in the print result.

Further, according to the evaluating tests in the fifth and sixth developing rollers, even when the print speed is low and the volume mean grain diameter of the toner is small, the defective printing such as dot drop-out or the like occurs in the print result. The following reason is considered for such a problem. That is, in the surface roughening process of the surface of the developing roller 2, the surface roughness is uneven, that is, the shape of the surface roughness in the circumferential direction of the developing roller 2 and that in the axial direction are largely different. Since the surface roughness is uneven, thickness dimensions of the toner layer locally differ, so that the charging characteristics are inferior, the toner is supplied from the developing roller 2, the development of the electrostatic latent image on the photosensitive drum 1 is not normally executed, and the defective printing such as dot drop-out or the like is liable to occur in the print result.

The following reason is also considered. That is, in Table 4, in the average cutting depth $C_{12AVE}$ as a ratio of the cutting depth $C_{1vn}$ in the circumferential direction to the cutting depth $C_{2vn}$ in the axial direction, the nearer the value of the average cutting depth approaches "1", the smaller the difference between the surface roughness in the circumferential direction and that in the axial direction is, and the uniform rough surface is formed in each direction.

When conditions in which the defective printing is difficult to occur in the case where the print speed is equal to, for example, 24 ppm are now considered on the basis of the foregoing evaluating tests, such conditions are satisfied when the toner whose volume mean grain diameter lies within a range of 4 to 6 μm is used and the printing using the first to fourth developing rollers is executed. When the index which satisfies the surface roughness in a range from the surface roughness in the first developing roller to the surface roughness in the fourth developing roller is specified by the average cutting depth $C_{12AVE}$ on the basis of Table 4, it is equal to 0.85 or more.

It can be also considered that when the average cutting depth $C_{12AVE}$ is equal to 0.85, although there is a risk that a fine line is formed in the circumferential direction in the print result, such a line is at a level which is inconspicuous when it is observed by the eyes, and even if a similar groove is formed in the axial direction, such a groove is at a level which is inconspicuous when it is observed by the eyes. Referring to Tables 5 and 6, if the average cutting depth $C_{12AVE}$ as a ratio $C_{1vn}/C_{2vn}$ of the cutting depth $C_{1vn}$ in the circumferential direction to the cutting depth $C_{2vn}$ in the axial direction lies within a range from 0.850 or more to 1.066 or less, the good print result can be obtained by executing the printing using the developing roller having the surface roughness formed in a range of [0.850, 1.066]. However, at this time, an average cutting depth $C_{21AVE}$ as a ratio $C_{2vn}/C_{1vn}$ of the cutting depth $C_{2vn}$ in the axial direction to the cutting depth $C_{1vn}$ in the circumferential direction lies within a range from 1/1.066 or more to 1/0.850 or less, that is, from 0.938 or more to 1.176 or less, the good print result can be also obtained by using the developing roller having the surface roughness formed in a range of [0.938, 1.176]. Therefore, the good print result can be obtained even when the printing is executed by using the developing roller having the surface roughness formed when the average cutting depth lies within a range of [0.850, 1.176] (in a range of [0.85, 1.18] obtained by rounding off those values).

That is, when the printing is executed under conditions in which the toner whose volume mean grain diameter lies within a range of 4 to 6 μm is used, the print speed is equal to or less than 32 ppm, and the developing roller whose surface has been roughened by the index of (0.85≦ average cutting depth $C_{12AVE}$≦1.18) is used, the good print result can be obtained.

The relation of (0.85≦ average cutting depth $C_{12AVE}$≦1.18) can be shown by the following relational expression (1).

Assuming that the cutting depth in the case where the load length ratio in the circumferential direction of the surface of the developing roller 2 is equal to n % is set to $C_{1vn}$ [μm] and the cutting depth in the case where the load length ratio in the axial direction of the surface is equal to n % is set to $C_{2vn}$ [μm], $$0.85 \leqq \frac{\sum_{n=1}^{100} \frac{C_{1Vn}}{C_{2Vn}}}{n} \leqq 1.18 \quad (1)$$

where, (n=10, 20, 30, 40, 50, 60, 70, 80, 90)

As mentioned above, according to the embodiment, by using the developing roller 2 which is indexed by the average cutting depth $C_{12AVE}$ (relation of 0.85≦ average cutting depth $C_{12AVE}$≦1.18) including the information of the roughness shape regarding each direction on the surface of the developing roller 2, in other words, by roughening the surface of the developing roller 2 by using the average cutting depth $C_{12AVE}$ (relation of 0.85≦ average cutting depth $C_{12AVE}$≦1.18) including the information of the roughness shape regarding each direction on the surface of the developing roller 2 as an index, the surface roughening process of the developing roller whose surface roughness is uniform in each direction can be executed without a difference between the surface roughness shape in the circumferential direction and the surface roughness shape in the axial direction. According to the printing process using such a developing roller, it is possible to prevent the defective printing such as dot drop-out or the like which is caused since the typical rough surface is formed in either the circumferential direction or the axial direction. The excellent print result can be obtained.

Embodiment 2

Subsequently, as shown in Table 7, the surface of each developing roller 2 is roughened, the developing roller 2 having the surface roughness shape shown by the indices such as 10-point average roughness Rz, arithmetic average roughness Ra, average interval Sm of the rough portions, and the like is further prepared. In addition to the six rollers used in the embodiment 1, the evaluating tests are executed under conditions similar to the experiment conditions in the embodiment 1 by using those developing rollers (the first to eighth rollers). Since the experiment results regarding the first to sixth rollers are the same as those in the embodiment 1, only the experiment results of the seventh and eighth rollers will be mentioned hereinbelow.

TABLE 7

| | | Test patterns | | | | | |
|---|---|---|---|---|---|---|---|
| | | Rz [μm] | | Ra [μm] | | Sm [μm] | |
| | Elastic layer | Circumferential direction | Axial direction | Circumferential direction | Axial direction | Circumferential direction | Axial direction |
| 7th | Rubber of JIS-A50° | 5.03 | 8.28 | 1.02 | 1.09 | 4.92 | 5.07 |
| 8th | Rubber of JIS-A50° | 4.43 | 3.81 | 1.10 | 0.92 | 5.83 | 6.61 |

Subsequently, in each developing roller 2, the cutting depths $C_{1vn}$ in the case where the load length ratio tp in the circumferential direction of the developing roller 2 is equal to n % (where, n=0, 10, 20, 30, 40, 50, 60, 70, 80, 90) and the cutting depths $C_{2vn}$ in the case where the load length ratio tp in the axial direction of the developing roller 2 is equal to n % (where, n=0, 10, 20, 30, 40, 50, 60, 70, 80, 90) are obtained. The cutting depths $C_{1vn}$ and $C_{2vn}$ in each developing roller are collected every load length ratio tp and the results are shown in Table 8 and Table 9.

TABLE 8

| | Cutting depths $C_{1vn}$ in the circumferential direction of the surface of the developing roller | | | | | | | | | |
|---|---|---|---|---|---|---|---|---|---|---|
| | $C_{1V0}$ | $C_{1V10}$ | $C_{1V20}$ | $C_{1V30}$ | $C_{1V40}$ | $C_{1V50}$ | $C_{1V60}$ | $C_{1V70}$ | $C_{1V80}$ | $C_{1V90}$ |
| 7th | 0 | 2.53 | 3.04 | 3.42 | 3.68 | 3.90 | 4.16 | 4.48 | 5.05 | 5.93 |
| 8th | 0 | 1.82 | 2.49 | 3.09 | 3.50 | 3.86 | 4.16 | 4.45 | 4.81 | 5.52 |

TABLE 9

| | Cutting depths $C_{2vn}$ in the axial direction of the surface of the developing roller | | | | | | | | | |
|---|---|---|---|---|---|---|---|---|---|---|
| | $C_{2V0}$ | $C_{2V10}$ | $C_{2V20}$ | $C_{2V30}$ | $C_{2V40}$ | $C_{2V50}$ | $C_{2V60}$ | $C_{2V70}$ | $C_{2V80}$ | $C_{2V90}$ |
| 7th | 0 | 3.32 | 4.01 | 4.43 | 4.75 | 5.02 | 5.34 | 5.62 | 6.03 | 6.73 |
| 8th | 0 | 1.63 | 2.07 | 2.42 | 2.65 | 2.92 | 3.19 | 3.49 | 4.20 | 4.64 |

As shown in Tables 8 and 9, since a value of a percentage (%) of the load length ratio tp is equal to 0 in each of the cutting depths $C_{1vn}$ and $C_{2vn}$, explanation will be made hereinbelow by using only the results in the case where tp lies within a range of 10 to 90%.

Subsequently, as shown in Table 10, a ratio of the cutting depths $C_{1vn}$ obtained at the load length ratio tp in the circumferential direction (where, n=10, 20, 30, 40, 50, 60, 70, 80, 90) to the cutting depths $C_{2vn}$ obtained at the load length ratio tp in the axial direction (where, n=10, 20, 30, 40, 50, 60, 70, 80, 90) is obtained every value of a percentage (%) of each load length ratio tp and an average of those ratios is obtained as a cutting depth $C_{12AVE}$.

TABLE 10

| | Ratio $C_{1vn}/C_{2vn}$ between the cutting depths in the circumferential direction and the axial direction | | | | | | | | | |
|---|---|---|---|---|---|---|---|---|---|---|
| | $C_{1V10}/C_{2V10}$ | $C_{1V20}/C_{2V20}$ | $C_{1V30}/C_{2V30}$ | $C_{1V40}/C_{2V40}$ | $C_{1V50}/C_{2V50}$ | $C_{1V60}/C_{2V60}$ | $C_{1V70}/C_{2V70}$ | $C_{1V80}/C_{2V80}$ | $C_{1V90}/C_{2V90}$ | Average |
| 7th | 0.762 | 0.757 | 0.773 | 0.774 | 0.776 | 0.780 | 0.797 | 0.837 | 0.880 | 0.793 |
| 8th | 1.112 | 1.203 | 1.277 | 1.319 | 1.325 | 1.303 | 1.273 | 1.144 | 1.190 | 1.238 |

The evaluating tests in which the 2-by-2 pattern printing is executed after completion of the low-duty printing of 1% mentioned above are executed by using the developing rollers 2. 100 formed dots are extracted from the print result by using the image analyzing software SALT, its area is measured, a diameter of a circular area corresponding to the measured area is obtained, and a comparison discrimination is made on the basis of the standard deviation σ of the diameter of the circle corresponding to the 100 dots.

In this comparison discrimination, as shown in Table 11, a table in which the print result when the standard deviation σ≦4.3 is indicated by "o" showing that the dot drop-out is inconspicuous when it is observed by the eyes and the print result when the standard deviation σ>4.3 is indicated by "×" showing that the dot drop-out is conspicuous when it is observed by the eyes is formed at each of the print speeds of 16 ppm and 20 ppm, and the dot drop-out due to the difference between the volume mean grain diameters of the toner particles in each print speed is shown as a table. As shown in Table 12, the dot drop-out states in the print speeds of 24 ppm and 32 ppm are shown as a table in place of the print speeds of 16 ppm and 20 ppm.

TABLE 11

| | Print test results (when 16 ppm, 20 ppm) | | | | | | | | | | | | | | |
|---|---|---|---|---|---|---|---|---|---|---|---|---|---|---|---|
| Toner grain | Print speed | | | | | | | | | | | | | | |
| diameter | 16 ppm | | | | | | | 20 ppm | | | | | | | |
| [μm] | 4 | 5 | 5.5 | 6 | 6.5 | 7 | 8 | 4 | 5 | 5.5 | 6 | 6.5 | 7 | 8 | $C_{12AVE}$ |
| 7th | ○ | ○ | ○ | ○ | X | X | X | ○ | ○ | ○ | ○ | X | X | X | 0.793 |
| 8th | X | X | X | X | X | X | X | X | X | X | X | X | X | X | 1.238 |

TABLE 12

| Toner grain diameter [μm] | Print test results (when 24 ppm, 32 ppm) Print speed 24 ppm 4 | 5 | 5.5 | 6 | 6.5 | 7 | 8 | 32 ppm 4 | 5 | 5.5 | 6 | 6.5 | 7 | 8 | $C_{12AVE}$ |
|---|---|---|---|---|---|---|---|---|---|---|---|---|---|---|---|
| 7th | ○ | ○ | ○ | ○ | X | X | X | ○ | ○ | ○ | ○ | X | X | X | 0.793 |
| 8th | X | X | X | X | X | X | X | X | X | X | X | X | X | X | 1.238 |

A reciprocal number of the value (0.793) of $C_{12AVE}$ in the seventh developing roller is equal to 1.261 and the value of $C_{12AVE}$ in the eighth developing roller is equal to 1.238. Therefore, a difference between those values is very small to be equal to 0.023. Further, a reciprocal number of the value (1.238) of $C_{12AVE}$ in the eighth developing roller is equal to 0.808 and the value of $C_{12AVE}$ in the seventh developing roller is equal to 0.793. Therefore, a difference between those values is very small to be equal to 0.015. It is considered that a difference between the roughness shapes in the circumferential direction and the axial direction in the seventh developing roller and the roughness shapes in the circumferential direction and the axial direction in the eighth developing roller is very small.

However, as shown in Tables 11 and 12, when the evaluating tests are executed by using the toner particles whose volume mean grain diameter is equal to 6 μm or less, the good test results can be obtained according to the evaluating tests using the seventh developing roller. The good test results cannot be obtained according to the evaluating tests using the eighth developing roller in which it is considered that the difference from the roughness shape of the seventh developing roller is very small.

The following reason is considered for such results. That is, since the value of the 10-point average roughness Rz of the eighth developing roller is smaller than that of the seventh developing roller (refer to FIG. 7) and the surface shape of the eighth developing roller is gentle, the holding performance of the toner 9 is low. Thus, the conveying performance of the toner 9 in the developing roller 2 is deteriorated. The toner is supplied from the developing roller 2, the development of the electrostatic latent image on the photosensitive drum 1 is not normally executed, and the good print results cannot be obtained.

The larger the value of the 10-point average roughness Rz is, the more the conveying performance of the toner 9 is improved and the more the image concentration increases. However, when considering the print inconvenience such as fog, fouling, or the like in which the toner is deposited to the portions where it is unnecessary to develop the toner image, it is desirable to set the value of the 10-point average roughness Rz to 10 μm or less.

Such a value is based on the results obtained after the evaluating tests have been executed by setting the value of Rz to a pitch of 1 μm in a range of 3 to 12 μm. It is desirable to set the value of the 10-point average roughness Rz to 5 to 10 μm.

From the results of the embodiment 1, particularly, from Tables 5 and 6 and the results of the embodiment 2, if the average cutting depth $C_{12AVE}$ as a ratio $C_{1vn}/C_{2vn}$ of the cutting depth $C_{1vn}$ in the circumferential direction to the cutting depth $C_{2vn}$ in the axial direction lies within a range from 0.793 or more to 1.066 or less, in other words, if it lies within a range of [0.793, 1.066], the good print result can be obtained by executing the printing using the developing roller whose surface has been roughened by the indices of (5 μm≦10-point average roughness Rz1 in the circumferential direction ≦10 μm) and (5 μm≦10-point average roughness Rz2 in the axial direction ≦10 μm).

However, at this time, if the average cutting depth $C_{21AVE}$ as a ratio $C_{2vn}/C_{1vn}$ of the cutting depth $C_{2vn}$ in the axial direction to the cutting depth $C_{1vn}$ in the circumferential direction lies within a range from 1/1.066 or more to 1/0.793 or less, in other words, if it lies within a range of [0.938, 1.261], the good print result can be obtained by executing the printing using the developing roller whose surface has been roughened by the indices of (5 μm≦10-point average roughness Rz1 in the circumferential direction ≦10 μm) and (5 μm≦10-point average roughness Rz2 in the axial direction ≦10 μm).

Therefore, the good print result can be obtained by executing the printing when the toner whose volume mean grain diameter lies within a range of 4 to 6 μm is used, the print speed is equal to 32 ppm or less, and the developing roller whose surface has been roughened by the indices of (5 μm≦10-point average roughness Rz1 in the circumferential direction ≦10 μm) and (5 μm≦10-point average roughness Rz2 in the axial direction ≦10 μm) is used. The values (0.79 and 1.26) are obtained by rounding off the values (0.793 and 1.261).

The above-mentioned relation is shown by the following relational expression (2).

Assuming that the cutting depth at the time when the load length ratio in the circumferential direction of the surface of the developing roller 2 is equal to n % is set to $C_{1vn}$ [μm] and the cutting depth at the time when the load length ratio in the axial direction is equal to n % is set to $C_{2vn}$ [μm], $$0.79 \leqq \frac{\sum_{n=1}^{100} \frac{C_{1Vn}}{C_{2Vn}}}{n} \leqq 1.26 \tag{2}$$

(n=10, 20, 30, 40, 50, 60, 70, 80, 90), (5 μm≦10-point average roughness Rz1 in the circumferential direction ≦10 μm), and (5 μm≦10-point average roughness Rz1 in the axial direction ≦10 μm).

As mentioned above, according to the embodiment, by using the developing roller 2 having the surface shape which is indexed by the average cutting depth $C_{12AVE}$ (0.79≦ average cutting depth $C_{12AVE}$≦1.26) including the roughness shape information in each direction on the surface of the developing roller 2, (5≦10-point average roughness Rz1 in the circumferential direction ≦10), and (5≦10-point average roughness Rz2 in the axial direction ≦10), in other words, by roughening the surface of the developing roller 2 by using the average cutting depth $C_{12AVE}$ (0.79≦ average cutting depth $C_{12AVE}$≦1.26) including the roughness shape information in each direction on the surface of the developing roller 2, (5≦10-point average roughness Rz1 in the circumferential direction ≦10), and (5≦10-point average roughness Rz2 in the axial direction ≦10) as indices, the surface roughening process of the developing roller having the surface roughness which is uniform in each direction can be executed without a difference between the surface roughness shape in the circumferential direction and the surface roughness shape in the axial direction, and the good toner holding performance can be obtained. Thus, according to the printing process using such a developing roller 2, since the typical rough surface is not formed in either the circumferential direction or the axial direction, the toner can be preferably held, and the defective printing such as dot drop-out or the like can be prevented, so that the good print result can be obtained.

According to the invention, when the load length ratio in each of the circumferential direction and the axial direction of the surface of the developing roller is equal to n %, "n" is assumed to be an integer. However, it is not always necessary to limit "n" to the integer but the invention can be also embodied by setting "n" to a real number.

Although the invention has been described by using the contact developing system, the invention is not limited to such a system but, naturally, it can also cope with the contactless developing system.

The invention is not limited to the foregoing embodiments but it should be understood by those skilled in the art that various modifications, combinations, sub-combinations and alterations may occur depending on design requirements and other factors insofar as they are within the scope of the appended claims or the equivalents thereof.

What is claimed is:

1. A developer holding body which is arranged so as to face an image holding body, holds a developer as a layer onto a roughened surface, and supplies said developer in order to develop an image which is formed on said image holding body, wherein said roughening is executed on the basis of a ratio of cutting depths in a plurality of directions, and wherein the ratio of the cutting depths in said plurality of directions is based on an average of the cutting depths in respective directions at a plurality of load length ratios.

2. The developer holding body according to claim 1, wherein the ratio of the cutting depths in said plurality of directions lies within a range from 0.85 or more to 1.18 or less, serving as a rough surface range.

3. The developer holding body according to claim 2, wherein said developer holding body is rotated and said rough surface range isnarrowed as a speed of said rotation rises.

4. The developer holding body according to claim 2, wherein a value of said rough surface range is narrowed as a volume mean grain diameter of the developer which is used increases.

5. The developer holding body according to claim 1, wherein said roughening is executed under conditions that the ratio of the cutting depths in said plurality of directions lies within a range from 0.79 or more to 1.26 or less, serving as a rough surface range, (5 μm≦10-point average roughness Rz1 in the circumferential direction≦10 μm), and (5 μm≦10-point average roughness Rz2 in the axial direction≦10 μm).

6. A developer holding body which is arranged so as to face an image holding body, holds a developer as a layer onto a roughened surface, and supplies said developer in order to develop an image which is formed on said image holding body, wherein assuming that a cutting depth at the time when a load length ratio in the circumferential direction of the surface of said developer holding body is equal to n % is set to $C_{1vn}$ [μm] and a cutting depth at the time when a load length ratio in the axial direction of said surface is equal to n % is set to $C_{2vn}$ [μm], a relational expression $$0.85 \le \frac{\sum_{n=m1}^{m2} \frac{C1vn}{C2nv}}{k} \le 1.18$$

where, n, m1, m2: real numbers (0<m1≦m2≦100)

k: the number of n is satisfied.

7. The developer holding body according to claim 6, wherein in a ratio of the cutting depth in the circumferential direction of the surface to the cutting depth in the axial direction of the surface which is shown by $C_{1vn}/C_{2vn}$ shown by said relational expression, a value of n % of each of the load length ratio in the circumferential direction of the surface and the load length ratio in the axial direction of the surface is equal to a value of one of (n=10, 20, 30, 40, 50, 60, 70, 80, 90).

8. A developer holding body which is arranged so as to face an image holding body, holds a developer as a layer onto a roughened surface, and supplies said developer in order to develop an image which is formed on said image holding body, wherein assuming that a cutting depth at the time when a load length ratio in the circumferential direction of the surface of said developer holding body is equal to n % is set to $C_{1vn}$ [μm], a cutting depth at the time when a load length ratio in the axial direction of said surface is equal to n % is set to $C_{2vn}$ [μm], a 10-point average roughness in the circumferential direction of the surface of said developer holding body is set to Rz1, and a 10-point average roughness in the axial direction of the surface is set to Rz2, respectively, relational expressions $$0.79 \le \frac{\sum_{n=m1}^{m2} \frac{C1vn}{C2nv}}{k} \le 1.26$$

5 μm≦Rz1≦10 μm, and

5 μm≦Rz2≦10 μm where, n, m1, m2: real numbers (0<m1≦m2≦100)

k: the number of n are satisfied.

9. The developer holding body according to claim 8, wherein in a ratio of the cutting depth in the circumferential direction of the surface to the cutting depth in the axial direction of the surface which is shown by $C_{1vn}/C_{2vn}$ shown by said relational expression, a value of n % of each of the load length ratio in the circumferential direction of the surface and the load length ratio in the axial direction of the surface is equal to a value of one of (n=10, 20, 30, 40, 50, 60, 70, 80, 90).

10. A developing apparatus having a developer holding body which is arranged so as to face an image holding body, holds a developer as a layer onto a roughened surface, and supplies said developer in order to develop an image which is formed on said image holding body, wherein said roughening is executed on the basis of a ratio of cutting depths in a plurality of directions, and wherein the ratio of the cutting depths in said plurality of directions is based on an average of the cutting depths in respective directions at a plurality of load length ratios.

11. The developing apparatus according to claim 10, wherein the ratio of the cutting depths in said plurality of directions lies within a range from 0.85 or more to 1.18 or less, serving as a rough surface range.

12. The developing apparatus according to claim 11, wherein said developer holding body is rotated and said rough surface range is narrowed as a speed of said rotation rises.

13. The developing apparatus according to claim 11, wherein a value of said rough surface range is narrowed as a volume mean grain diameter of the developer which is used increases.

14. The developing apparatus according to claim 10, wherein said roughening is executed under conditions that the ratio of the cutting depths in said plurality of directions lies within a range from 0.79 or more to 1.26 or less, serving as a rough surface range, (5 μm≦10-point average roughness Rz1 in the circumferential direction ≦10 μm), and (5 μm≦10-point average roughness Rz2 in the axial direction ≦10 μm).

15. A developing apparatus which is arranged so as to face an image holding body, holds a developer as a layer onto a roughened surface, and supplies said developer in order to develop an image which is formed on said image holding body, wherein assuming that a cutting depth at the time when a load length ratio in the circumferential direction of the surface of said developer holding body is equal to n % is set to $C_{1vn}$ [μm] and a cutting depth at the time when a load length ratio in the axial direction of said surface is equal to n % is set to $C_{2vn}$ [μm], a relational expression $$0.85 \le \frac{\sum_{n=m1}^{m2} \frac{C1vn}{C2nv}}{k} \le 1.18$$

where, n, m1, m2: real numbers (0<m1≦m2≦100)

k: the number of n is satisfied.

16. The developing apparatus according to claim 15, wherein in a ratio of the cutting depth in the circumferential direction of the surface to the cutting depth in the axial direction of the surface which is shown by $C_{1vn}/C_{2vn}$ shown by said relational expression, a value of n % of each of the load length ratio in the circumferential direction of the surface to the load length ratio in the axial direction of the surface is equal to a value of one of (n=10, 20, 30, 40, 50, 60, 70, 80, 90).

17. A developing apparatus which is arranged so as to face an image holding body, holds a developer as a layer onto a roughened surface, and supplies said developer in order to develop an image which is formed on said image holding body, wherein assuming that a cutting depth at the time when a load length ratio in the circumferential direction of the surface of said developer holding body is equal to n % is set to $C_{1vn}$ [μm], a cutting depth at the time when a load length ratio in the axial direction of said surface is equal to n % is set to $C_{2vn}$ [μm], a 10-point average roughness in the circumferential direction of the surface of said developer holding body is set to Rz1, and a 10-point average roughness in the axial direction of the surface is set to Rz2, respectively, relational expressions $$0.79 \le \frac{\sum_{n=m1}^{m2} \frac{C1vn}{C2nv}}{k} \le 1.26$$

5 μm≦Rz1≦10 μm, and

5 μm≦Rz2≦10 μm where, n, m1, m2: real numbers (0≦m1≦m2≦100)

k: the number of n are satisfied.

18. The developing apparatus according to claim 17, wherein in a ratio of the cutting depth in the circumferential direction of the surface to the cutting depth in the axial direction of the surface which is shown by $C_{1vn}/C_{2vn}$ shown by said relational expression, a value of n % of each of the load length ratio in the circumferential direction of the surface to the load length ratio in the axial direction of the surface is equal to a value of one of (n=10, 20, 30, 40, 50, 60, 70, 80, 90).

* * * * *